US005428875A

United States Patent [19]

Nguyen et al.

[11] Patent Number: 5,428,875

[45] Date of Patent: Jul. 4, 1995

[54] THEFT DETERRENT TAG WITH A CUTTING BLADE

[75] Inventors: Thang T. Nguyen, Boca Raton; Alan Willard, Wellington, both of Fla.

[73] Assignee: Sensormatic Electronics Corporation, Deerfield Beach, Fla.

[21] Appl. No.: 153,357

[22] Filed: Nov. 16, 1993

[51] Int. Cl.[6] ..... A44B 9/00

[52] U.S. Cl. ..... 24/704.1; 24/711.4; 70/57.1

[58] Field of Search ..... 411/923, 484, 399, 187, 411/188, 3; 24/704.1, 711.4; 70/57.1

[56] References Cited

U.S. PATENT DOCUMENTS 1,839,798 1/1932 Meader ..... 411/923 X 1,946,800 2/1934 MacLean ..... 411/399

3,942,829 3/1976 Humble et al. .

3,995,900 12/1976 Humble et al. .

4,483,049 11/1984 Gustavsson et al. .

4,649,397 3/1987 Heaton et al. .

5,054,172 10/1991 Hogan et al. .

*Primary Examiner*—James R. Brittain

*Attorney, Agent, or Firm*—Robin, Blecker, Daley & Driscoll

[57] ABSTRACT

A theft deterrent tag for protecting an article is disclosed wherein the tag comprises a tag body, a tack-like assembly for securing the tag body to an article and a cutting blade for cutting the article upon a preselected force being applied to the tag body or the tack-like assembly.

10 Claims, 3 Drawing Sheets

THEFT DETERRENT TAG WITH A CUTTING BLADE

This invention relates to theft deterrent devices and, in particular, to a theft deterrent tag for attachment to an article and adapted to damage the article upon unauthorized removal from the article.

Preventing theft of clothing, garments and other articles in the retail environment is particularly difficult. Various types of theft deterrent tags have been developed in an attempt to prevent this type of theft. In one type of theft deterrent tag, the tag is designed to trigger security systems situated at preselected interrogation areas (e.g., store exits) when the tag passes such areas.

Various techniques having been tried by would-be thieves to remove these so-called electronic article surveillance ("EAS") tags from their articles in an attempt to defeat the tags. Thus, tag removal has been attempted by cutting the stem of the tack-like assembly securing the tag to the article, by using tools to remove the entire tack-like assembly from the tag or by cutting a large enough slit in the article to allow the plastic head of the tack-like assembly to slide out. As a way of countering these techniques, tag designers have modified the tag design so that the tag damages the article attached to the tag when the tag is tampered with in an attempt remove the tag from the article.

In one theft deterrent tag of this type, a detrimental substance such as ink or a foul-smelling liquid is disposed within the tag and emitted to damage the article if an unauthorized removal of the tag is attempted. An example of this type of tag is the tag disclosed in U.S. Pat. No. 4,483,049 to Gustavsson, et al. The Gustavsson, et al. tag contains a heavily staining and/or ill-smelling substance held in glass ampoules which break if an attempt is made to remove the tag by force from the article. Another example is the tag described is U.S. Pat. No. 4,649,397 to Heaton et al. In this tag, vials containing a staining substance are damaged upon an attempted forceful removal of the tag and an electronic device is mounted in one side of the tag for indicating electronically whether the article has been removed from the store or other area to be protected.

Yet another tag of this type is disclosed in U.S. Pat. No. 5,054,172 to Hogan et al. In the Hogen, et al. tag, the pin of the tack-like assembly used to secure the tag to the article contains a breaker element. This element has a wedge-shaped surface which applies pressure against and fractures glass vials to release a detrimental substance, when a predetermined pressure is applied to the tag.

While the above-described theft deterrent tags have proved successful, efforts are still underway to provide theft deterrent tags having improved or more desirable tamper proof capability.

It is, therefore, an object of the present invention to provide an improved theft deterrent tag for articles.

It is a further object of the present invention to provide an improved theft deterrent tag that damages the article upon attempted unlawful or unauthorized removal of the theft deterrent tag.

SUMMARY OF THE INVENTION

In accordance with the principles of the present invention the above and other objectives are realized in a theft deterrent tag for protecting an article which comprises a tag body, engaging means adapted to engage the article and the tag body for securing the tag body to the article and cutting means for cutting the article upon application of a preselected force to one or more of the tag body and engaging means.

In a first embodiment of the present invention, the engaging means of the tag body comprises a tack-like assembly including a stem having a pointed end for piercing and passing through the article and to be received by the tag body. The tack-like assembly also includes a cap attached to the other end of the stem for holding the article to the tag body. A cutting blade is mounted to the stem within an area surrounded by the walls of the cap and the tack-like assembly is adapted to allow the cutting blade to cut the article upon application of a preselected force to the tag body and/or the tack-like assembly. To this end, the cap is configured to fracture about its upper periphery upon application of such force, thereby exposing the cutting blade to the article.

In another embodiment of the invention, the tack-like assembly includes a breaker element disposed within a cavity in the cap of the assembly. This breaker element is positioned to break fragile vials also disposed within the cavity and containing a detrimental substance upon application of a preselected force to the tag body and/or tack-like assembly. In this case, a cutting blade is slidably mounted to the stem exteriorly of the cavity in the cap but within an area surrounded by the walls of the cap. The cutting blade is urged away from this area to cut the article by a sleeve surrounding the stem and slidably mounted to the cap upon the sleeve being engaged by the breaker element after the breaker element has fractured the vials.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
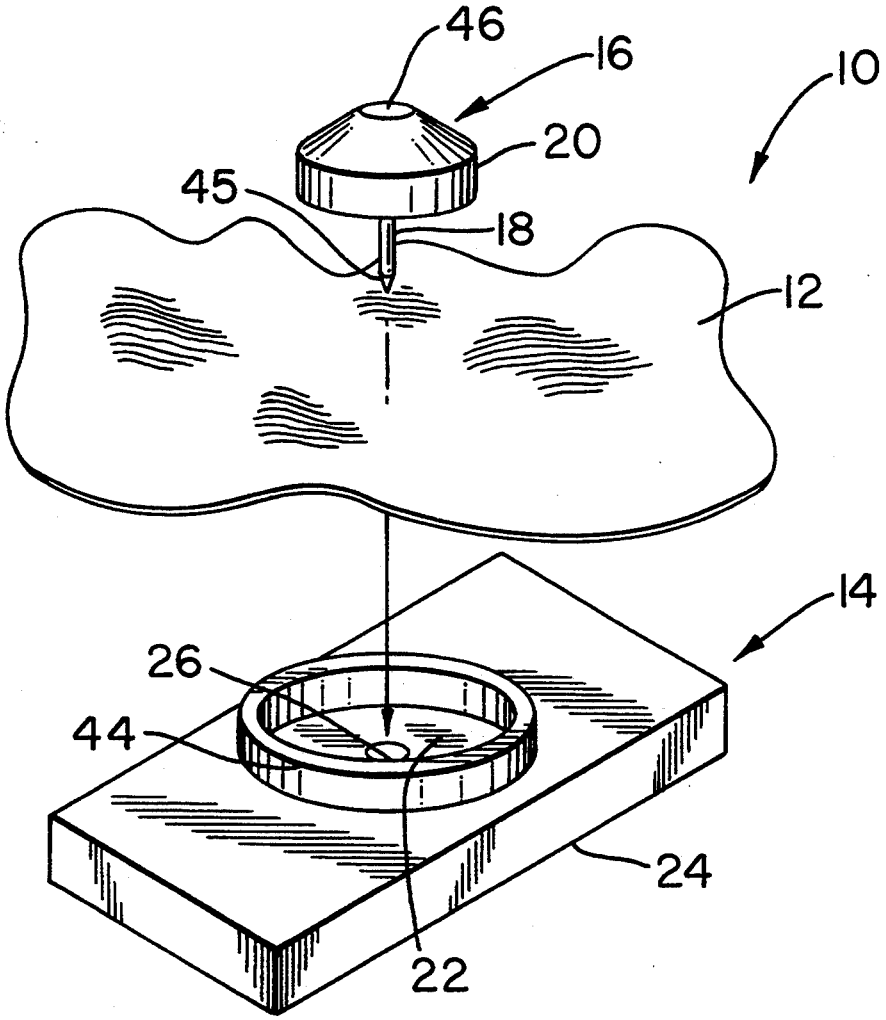
FIG. 1 shows a partially exploded perspective view of a theft deterrent tag for attachment to an article in accordance with the principles of the present invention.

FIG. 1 shows a theft deterrent tag 10 in accordance with the principles of the present invention. As shown, the theft deterrent tag 10 is to be attached to an article or garment 12 and comprises a tag body 14 and an engaging means in the form of a tack-like assembly 16.

The tack-like assembly 16 is adapted to engage the article 12 and the tag body 14 for securing the tag body and article together. As shown, the tack-like assembly 16 includes a stem 18 having a first end 46 which is attached to a cap 20. The second end 45 of the stem 18 is pointed for piercing and passing through the article 12. This brings the cap 20 into engagement with the article 12 so that the article 12 is secured between the cap 20 and the tag body 14.

In FIG. 1, the tag body 14 is provided with means for receiving and holding the stem 18 of the tack-like assembly 16. More particularly, the tag body 14 includes a housing 24 having an area 22 surrounded by a wall 44 and provided with an opening 26. The stem 18 of the tack-like assembly 16, after piercing and passing through the article 12, passes into the opening 26 with the cap 20 seating on the area 22 surrounded by the wall 44. A clutch lock or like mechanism (not shown) in the housing 24 receives and holds the stem 18 securely in place and thereby the tag 10 to the article 12. A typical clutch lock mechanism might be the one disclosed in U.S. Pat. No. 3,995,990 to Humble, et al.

As can be appreciated, the wall 44 encircles the cap 20 when the cap is seated on the area 22 and prevents access to the stem 18 at the interface between the cap 20 and the housing 24. This helps deter cutting of the stem 18 at the interface location.

Also included in the tag housing 24, is a sensor element or an electronic device (not shown) which permits the tag 10 to be detected upon unauthorized removal of the article 12 from the store or area where it is located. The sensor or electronic device might be a device, such as disclosed in U.S. Pat. Nos. 4,063,229, 4,510,489 or 4,660,025. Such a sensor or electronic device would be detected by suitable equipment located near the exits of the store or premises, as disclosed in the aforesaid patents.

In accordance with the principles of the present invention, the theft deterrent tag 10 is further adapted to prevent tampering with the tag so as to deter removal of the tag from the article 12. To this end, the tag 10 is providing with a cutting mechanism which causes the article 12 to be cut and, therefore, damaged when preselected force is applied to the tag body 14, the cap 20 or the article 12 in trying to detach the tag from the article.

Figure 2:
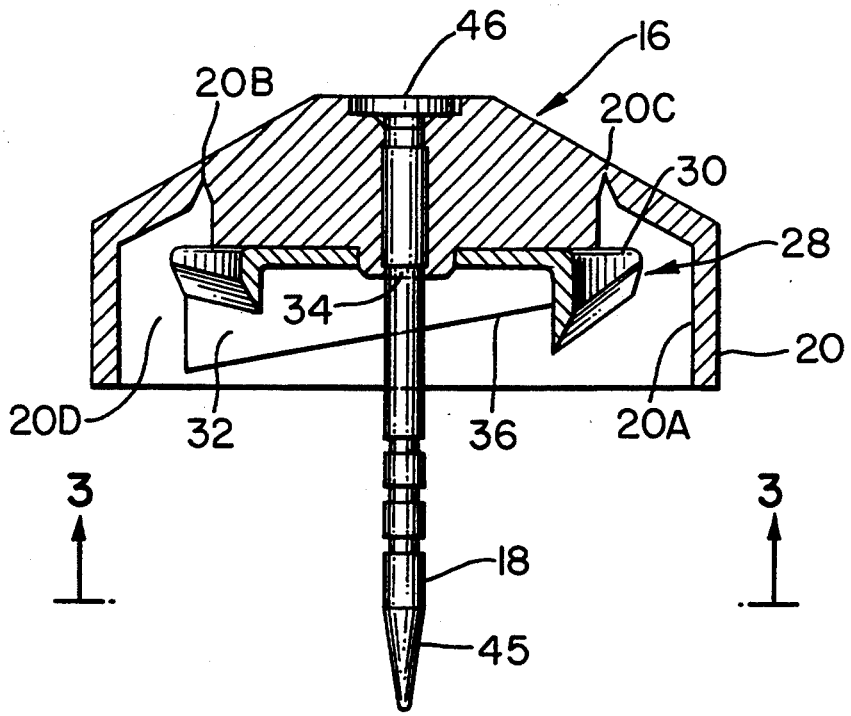
FIG. 2 shows a partial cross-sectional view of a tack-like assembly included in the theft deterrent tag of FIG. 1.
Figure 3:
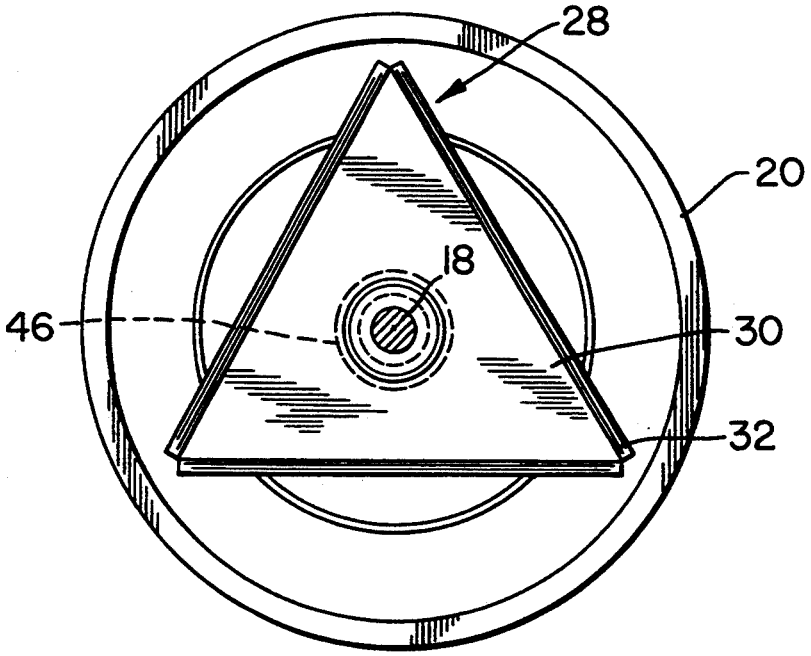
FIG. 3 illustrates a sectional view of the tack-like assembly shown in FIG. 2 taken along line 3—3 of FIG. 2.

As seen in FIGS. 2 and 3, the aforesaid cutting mechanism comprises a cutting member 28 affixed to the stem 18 below its end 46. In the case shown, the cutting member is mounted within an area 20D surrounded by the walls 20A of the cap 20. The cap 20 is, in turn, provided with a relief or weakened area 20B which allows the walls 20A of the cap to break around the peripheral area 20C when the aforementioned preselected force is applied to the cap, tag body or article. This permits the cutting blade 28 to engage the article 12 and thereby cut the article as the tack-like assembly and cap are being forcibly detached from the tag body.

Figure 4:
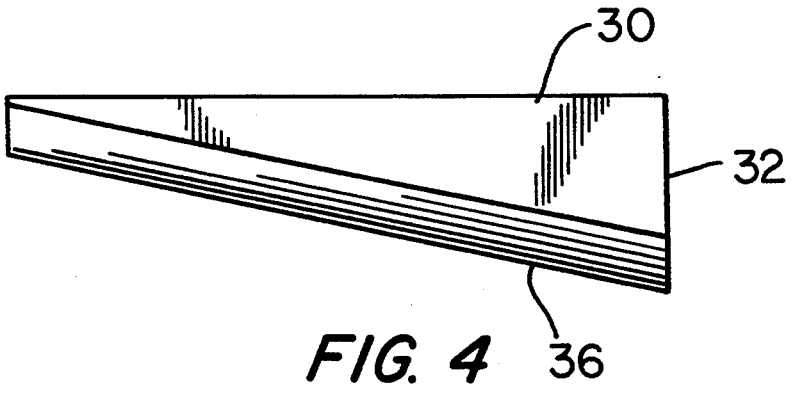
FIG. 4 shows a view of one of the blades of the cutting member of the tack-like assembly shown in FIG. 2.

As shown in FIG. 3, the cutting member 28 includes a triangular base 30 from whose sides extend cutting blades 32. Each of these blades is triangular in shape with a sharpened cutting surface or edge 36 as shown in FIG. 4.

In the present case, the cutting member 28 is coaxial with and mounted to the stem 18 of the tack-like assembly 16 in order to secure the member 28 within the confines of the walls of the cap 20. This provides a stable mounting for the cutting member 28 when a force is applied to the cap or tag body. However, the cutting member 28 may also be supported in other ways within the cap 20 and can have other blade configurations as long as the cutting member is brought into engagement with the article when the preselected force is applied.

Figure 5:
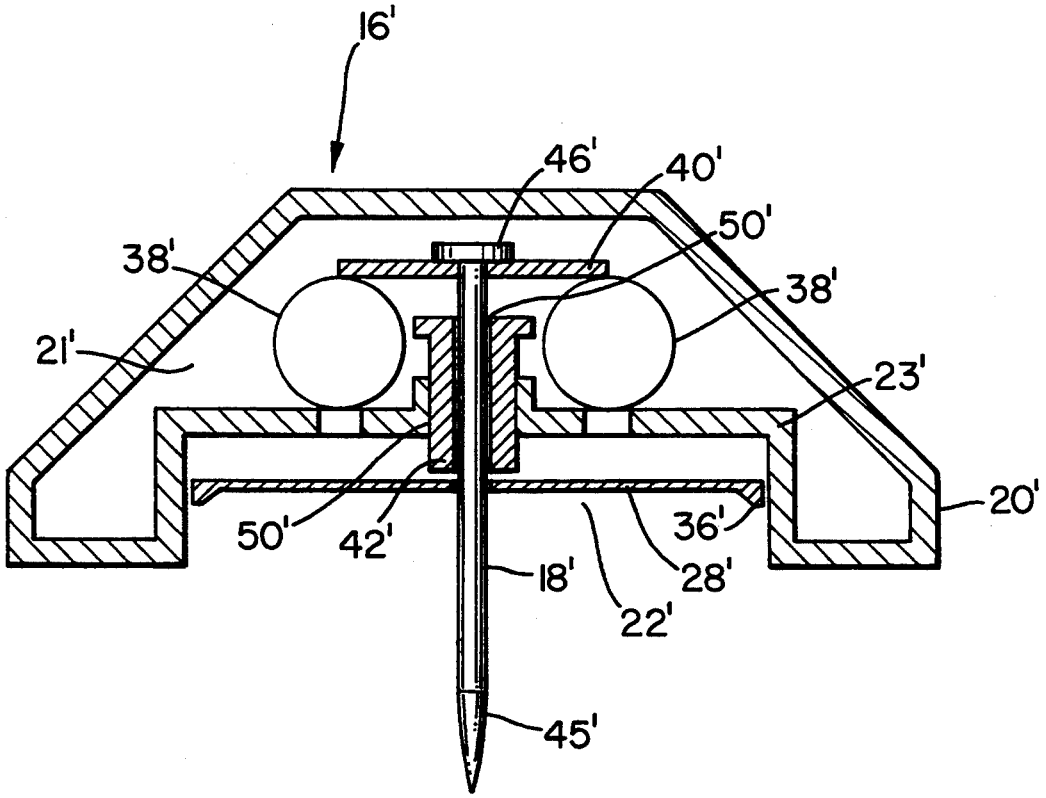
FIG. 5 illustrates a further embodiment of a tack-like assembly usable in the theft deterrent tag of FIG. 1.

FIG. 5 illustrates a second embodiment of a tack-like assembly 16′ incorporating a cutting member 28′ and usable with the tag body 14 of FIG. 1 to realize a theft deterrent tag in accordance with the invention. In this embodiment, the tack-like assembly 16′ and its cap 20′ are of a type used in theft deterrent tags in which destructive substances are caused to be emitted when there is an unauthorized tampering with the tag.

As shown in FIG. 5, the cutting blade 28′ is slidably mounted to the stem 18′ of the tack-like assembly 16′. The blade 28′ is mounted so as to be outside the cavity 21′ defined by the cap 20′, but within an area 22′ surrounded by the walls 23′ of the cap. Mounted within the cavity 21′ of the cap 20′ on the opposite sides of the stem 18′ are fragile vials 38′ made of glass or the like. Each of these vials contains ink or a foul-smelling substance which spills out when the respective vial is broken or fractured, leaving the article 12 damaged and/or ruined.

A breaker 40′ is coaxially affixed to the stem 18′ abutting its top end 46′ and so that it is adjacent to the vials 38′. The breaker 40′ fractures the vials 38′ upon the application of a preselected force to one or more of the tag body 14, the tack-like assembly 16′ and/or the article 12. When the preselected force is applied and the breaker 40′ engages and fractures the vials 38′, the breaker 40′ moves downward with the stem 18′ to engage a sleeve 42′.

The sleeve 42′ is in coaxial relationship with the stem 18′ and is slidably mounted in an aperture 50′ in the lower part of the walls 23′ of the cap 20′ just above the cutting blade 28′. As the breaker and stem continue downward, the engaged sleeve 42′ is also moved downward. This downward movement causes the sleeve 42′ to meet the cutting blade 28′. The blade is thereby forced away from the area 22′ and against the article 12 as the article 12 is being pulled over its edges 36′. The article 12 is thereby cut, adding to the damage caused by the substance issued from the vials 38′.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. A theft deterrent tag for protecting an article, said tag comprising:

a tag body including means for receiving and holding a stem of a tack-like assembly at a first end;

engaging means adapted to engage said article and said tag body for securing said tag body to said article, said engaging means including a tack-like assembly comprising: a stem having first and second ends, said first end being pointed for piercing and passing through said article and being adapted to be received and held by said receiving and holding means of said tag body and said second end being adapted to engage said article; a cap having walls including a weakened area which is adapted to break upon a preselected force being applied, said second end of said stem being affixed to said cap and the walls of said cap extending along the length of said stem;

and a cutting means for cutting said article upon application of said preselected force to one or more of said tag body and said engaging means, said cutting means including a cutting blade and being mounted to said stem so as to be within an area surrounded by the walls of said cap and so as to be brought into cutting engagement with said article when said preselected force is applied and the weakened area in the walls of said cap break.

2. A theft deterrent tag in accordance with claim 1, wherein:

said cutting blade includes cutting edges arranged in a triangular configuration.

3. A theft deterrent tag in accordance with claim 2, wherein:

said cutting edges of said cutting blades are each of triangular configuration.

4. A theft deterrent tag in accordance with claim 1, wherein:

said receiving and holding means includes an aperture in said tag body which receives said stem at said pointed end.

5. A theft deterrent tag in accordance with claim 1, further comprising:

one of magnetic, electronic and microwave means for permitting said tag to be sensed.

6. A theft deterrent tag for protecting an article, said tag comprising:

a tag body including: means for receiving and holding a stem of a tack-like assembly at a first end, said receiving and holding means including an aperture in said tag body which receives a pointed end of said stem of said tack-like assembly; a wall encircling said aperture and into which a cap of said tack-like assembly is received when said stem at said pointed end is received in said aperture;

engaging means adapted to engage said article and said tag body for securing said tag body to said article, said engage means including a tack-like assembly, said tack-like assembly comprising: a stem having first and second ends, said first end being pointed for piercing and passing through said article and said second end being adapted to engage said article; and a cap having walls, said second end of said stem being affixed to said cap and the walls of said cap extending along the length of said stem; and cutting means for cutting said article upon application of a preselected force to one or more of said tag body and said engaging means, said cutting means including a cutting blade and being mounted to said stem so as to be within an area surrounded by said walls of said cap and so as to be brought into cutting engagement with said article when said preselected force is applied.

7. A theft deterrent tag for protecting an article, said tag comprising:

a tag body including means for receiving a stem of a tack-like assembly at a first end;

engaging means adapted to engage said article and said tag body for securing said tag body to said article, said engaging means including a tack-like assembly comprising a stem having first and second ends, said first end being pointed for piercing and passing through said article and said second end being adapted to engage said article;

cutting means for cutting said article upon application of a preselected force to one or more of said tag body and said engagement means, said cutting means being mounted to said stem so as to be brought into cutting engagement with said article when said preselected force is applied; and means for emitting a detrimental substance upon application of a preselected force to one or more of said tag body and said engaging means.

8. A theft deterrent tag in accordance with claim 7, wherein:

said tack-like assembly includes: a cap having walls and including a cavity, said second end of said stem being disposed within said cavity and said first end of said stem being disposed exteriorly of said cavity and within an area surrounded by the walls of said cap; a sleeve slidably mounted in a wall of said cap bordering said area, said stem at said second end being slidably mounted in said sleeve; and a breaker affixed to said second end of said stem;

and said means for emitting said detrimental substance includes one or more vials containing said substance, said vials being disposed within said cavity and supported on the said wall of said cap bordering said area, said breaker upon said preselected force being applied breaking said vials and engaging said sleeve to cause said sleeve to engage said blade and move said blade from within said area so as to be able to cut said article.

9. A theft deterrent tag in accordance with claim 7 further comprising:

one of magnetic, electronic and microwave means for permitting said tag to be sensed.

10. A theft deterrent tag for protecting an article, said tag comprising:

a tag body;

engaging means adapted to engage said article and said tag body for securing said tag body to said article;

cutting means for cutting said article upon application of a preselected force to one or more of said tag body and said engaging means; and means for emitting a detrimental substance upon application of a preselected force to one or more of said tag body and said engaging means.

* * * * *